United States Patent [19]

Morrison et al.

[11] 4,132,402

[45] Jan. 2, 1979

[54] SHEET FEED MONITOR APPARATUS

[75] Inventors: Wilbur J. Morrison; Norwood E. Tress, both of Bath, Pa.

[73] Assignee: Bell & Howell Company, Phillipsburg, N.J.

[21] Appl. No.: 797,881

[22] Filed: May 17, 1977

Related U.S. Application Data

[60] Division of Ser. No. 594,255, Jul. 9, 1975, Pat. No. 4,043,551, which is a continuation-in-part of Ser. No. 569,989, Apr. 21, 1975, Pat. No. 4,079,576.

[51] Int. Cl.[2] ..... B65H 7/12

[52] U.S. Cl. ..... 271/263; 192/127; 270/56

[58] Field of Search ..... 271/263, 262; 270/56; 192/127; 340/259

[56] References Cited

U.S. PATENT DOCUMENTS

| | | | |
|---|---|---|---|
| 2,670,954 | 3/1954 | Bach | 271/263 |
| 2,783,882 | 3/1957 | Griffin et al. | 271/263 X |
| 3,371,331 | 2/1968 | Buckholz | 340/259 |
| 3,458,042 | 7/1969 | Mestre | 271/263 X |
| 3,902,708 | 9/1975 | Wise et al. | 270/58 |

*Primary Examiner*—Bruce H. Stoner, Jr.

*Attorney, Agent, or Firm*—Griffin, Branigan and Butler

[57] ABSTRACT

A mistake detector for an In-Line Inserter includes complementary metallic detecting rolls positioned slightly downstream of ejection rolls of a pull-foot sheet feeding system. One of the detecting rolls is moveable and is attached to a detection feeler which is positioned between detection points. The detection points are also moveably mounted so that their positions can be overridden by excessive movement of the detection feeler.

12 Claims, 5 Drawing Figures

SHEET FEED MONITOR APPARATUS

This invention relates broadly to the art of sheet feeding devices, and more specifically is a division of application Ser. No. 594,255 filed July 9, 1975, now U.S. Pat. No. 4,043,551, which is, in turn, a continuation-in-part of U.S. patent application Ser. No. 569,989, fild on Apr. 21, 1975, now U.S. Pat. No. 4,079,576, by Wilbur J. Morrison and Norwood E. Tress for an In-Line Inserter. This invention also relates to U.S. Pat. Nos. 4,013, 283 and 4,060,228 of Winston A. Orsinger and Norwood E. Tress, for a Pull-Foot Sheet Feeding Device.

BACKGROUND OF THE INVENTION

The in-line inserter of the Morrison, et al application mentioned above, and the pull-foot sheet feeding device used therein, can be improved in several ways. In this regard, it has been found that it is difficult to obtain access to the suction cup and bottom roller of the insert pull-foot feeding devices in the in-line inserter. Thus, it is an object of this invention to provide structure for making it easier for an operator to gain access to these mechanisms.

Further, it has been found that when the bottom roller is used for detecting doubles and misses, as is described in the Orsinger, et al application mentioned above, that mistake readings are sometimes not obtained even though sheets are not actually fed. That is, the bottom roller and the pull foot might close, on a sheet for example, at which time the bottom roller gives no indication of a mistake; but then when the pull foot reciprocates outwardly, the detected sheet might not be carried with the pull foot. Thus, a mistake reading is not produced even though the sheet is not fed. It is therefore an object of this invention to provide a mistake detector which is more reliable for a pull-foot feeding mechanism.

Similarly, in prior art mistake detectors, detection feelers were often flexible so that they could flex upon making contact with detection points. Such flexing is intended to allow an attached moveable detection roll, or other type follower, to move still further and thereby allow sheets to pass the moveable detection roll. However, a flexible detection feeler is somewhat sloppy in movement and, over a period of time, deforms. Thus, it is an object of this invention to provide a rigid detection feeler but yet allow its moveable detection roll sufficient freedom of movement to handle undue numbers of simultaneously fed sheets.

Another area in which the in-line inserter described in the Morrison, et al application can be improved is in the mechanism for transferring envelopes from the pull-foot envelope feeding device to its chain/clamp mechanism. The problem is that it is difficult to time the insertion of envelopes into the mouths of the clamps as the machine speed is varied immediately before the clamps close. In addition, it is difficult to control the orientations of the envelopes as they are so fed. Therefore, it is an object of this invention to provide a transfer conveying system for properly conveying sheets at controlled speeds and orientations.

SUMMARY

According to principles of this invention, an in-line inserter has separate laterally spaced, ejection roll sets which are on separate axles. In this regard, there are no obstructions between the laterally spaced ejection roll sets. Thus, a free space is left between the ejection roll sets so that an operator can have access to the suction cup of a pull-foot sheet feeding device.

In addition, a mistake detector is positioned slightly downstream of the ejection roll sets, so that it does not provide a reading until sheets are actually being transported by the ejection roll sets. The detector comprises a moveable detection roll which is attached to a rotatable detector lever including a detection feeler. Stationary detection points are positioned on opposite sides of the detection feeler so that the feeler makes contact with one of the opposite points when there is either a "miss" or a "double." The stationary points are mounted on a rotatable point lever. Thus, when there are so many simultaneously fed sheets that the detection feeler must move further than the stationary "doubles" point, the point lever rotates to allow such movement.

The detection system of this invention also includes an adjustable counter for counting the number of mistakes, and for providing an indication of such mistakes only after a predetermined number of mistakes greater than one within a predetermined number of feeds. In one embodiment, the mistakes must be consecutive and four mistakes are required for an indication.

According to further principles of this invention, a transporting mechanism for transporting envelope pull-foot feeding device to a stuffing station includes a transition conveyor having both fast and low-speed parallel endless conveyors. The low speed conveyor has pins thereon against which the fast conveyor drives and holds transported envelopes. The pins, thus, control the orientations and speeds at which the envelopes are fed. Such a system is used in one embodiment in combination with a chain/clamp conveyor to guide the envelopes into the mouths of the clamps. In another embodiment, it is used in connection with a drum/belt conveyor.

BRIEF DESCRIPTION OF THE DRAWINGS

The foregoing and other objects, features and advantages of the invention will be apparent from the following more particular description of the preferred embodiment of the invention, as illustrated in the accompanying drawings, in which reference characters refer to the same parts throughout the different views. The drawings are not necessarily to scale, emphasis instead being placed upon illustr ating principles of the invention in a clear manner.

DESCRIPTION OF THE PREFERRED EMBODIMENT

Figure 1:
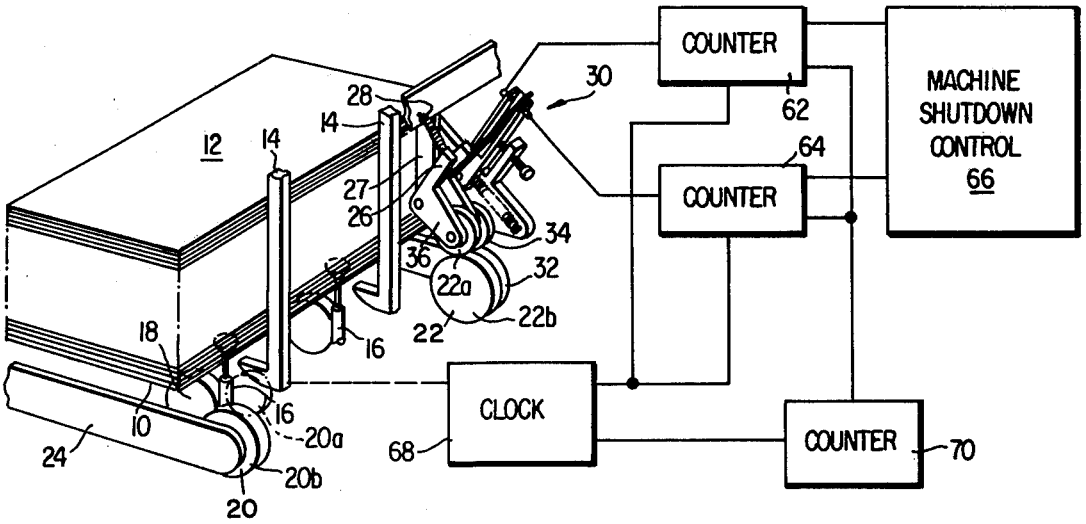
FIG. 1 is an isometric, partially schematic, drawing of a pull-foot insert feeding device for an in-line inserter employing principles of this invention.
Figure 2:
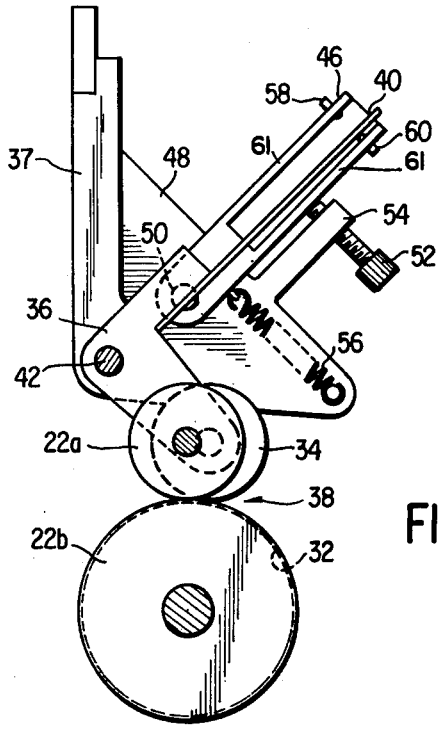
FIG. 2 is a section taken of a portion of the FIG. 1 device depicting a mistake detector.

Referring now to FIGS. 1 and 2, a pull-foot insert feeding mechanism for use with an in-line inserter of the Morrison application, Ser. No. 569,989, filed Apr. 21, 1975, is depicted. In this system, bottom-most inser ts 10 in a hopper held stack 12 are withdrawn, one at a time by pull-foot feeding devices 14. In operation, a bottom-most insert 10 is bent away from the hopper held stack 12 by a reciprocating suction cup 16. The pull-foot feeding devices 14 are then cammed to positions in which their "feet" are between the bottom-most insert 10 and the hopper-held stack 12. Bottom rollers 18 are then cammed upwardly to pinch the bottom-most insert between the heel of the pull-foot feeding devices 14 and the bottom rollers 18. The pull-foot feeding devices 14 are then cammed outwardly, away from the hopper-held stack 12, to the right in FIG. 1, pulling the bottom-most insert 10 with it until the bottom-most insert is finally gripped by driven sets of ejection rolls 20 and 22. The ejection rolls 20 and 22 feed the inserts to additonal transporting mechanisms which will be described below. It might be noted that the ejection rolls 20 and 22 may be one-way clutched so that their speed can be increased to follow that of an insert as it is driven faster by additional transporting mechanisms.

With reference to the sets of ejection rolls 20 and 22, each set includes upper and lower ejection rolls **20*a* and 22*a* and lower ejection rolls 20*b* and 22*b*. The lower ejection rolls 20*b* and 22*b* are mounted on a stationary frame member 24. However, the upper ejection rolls 20*a* and 22*a* are mounted on ejection roll levers 26 (not shown for upper ejection roll 20*a* for the sake of simplicity). The ejection roll levers 26 are pivotally mounted on stationary frame members 27 and are biased by springs 28 to urge the upper ejection rolls 20*a* and 22*a* toward the lower ejection rolls 20*b* and 22*b*** to thereby hold sheets between the upper and lower rolls, but to also allow the upper and lower rolls to part so that an undue number of simultaneously fed sheets can pass between the rolls.

Mounted adjacent to one of the sets of ejection rolls (set 22 in FIG. 1) is a mistake, or double/miss, detector 30. The double/miss detector comprises a lower, stationary, metallic detection roll 32 which is concentric with, and approximately equal in size to, the lower ejection roll **22*b*. The upper detection roll 34 is mounted on a detection lever 36 (FIG. 2) which is pivotally mounted to the frame 37. The upper ejection roll 22*a* is shown in FIG. 2, however, the ejection roll lever 26 on which the upper-ejection roll 22*a* is mounted is not shown in FIG. 2 for the sake of clarity. It can be seen in FIG. 2 that the upper detection roll 34 forms a nip 38 with the lower detection roll 32, which is slightly downstream of the nip formed between the upper and lower ejection rolls 22*a* and 22*b***.

The detection lever 36 includes a rigid detection feeler 40 which moves with the detection lever 36. The detection lever 36 is mounted at a pivot 42 to a portion of the stationary frame 37. A point arm 46 is also pivotally attached to a recessed portion 48 of the stationary frame 37 at a pivot 50. The point arm 46 is held in a stationary position against the tip of an adjusting screw 52, which is screwed into a portion 54 of the frame 37, by a contracting spring 56 which is mounted between the frame 37 and the point arm 46.

The point arm 46 has a "double" electrical contact 58 and a "miss" electrical contact 60 mounted in sidewalls 61 thereof.

With reference to FIG. 1, the double and miss electrical contacts 58 and 60 are respectively attached to counters 62 and 64 which store counts up to predetermined amounts and then eject signals to a machine shutdown control 66. The counters 62 and 64 accept signals received from the double and miss electrical contacts 58 and 60 at times selected by a clock 68. The clock 68 is in turn, driven by linkage with the pull-foot feed devices 14 to provide a clock pulse for each reciprocation of the pull-foot feeding devices 14. In another embodiment, not shown, a reset detector is provided for resetting the counters 62 and 64 in response to each proper feed. Thus, only consecutive mistakes can activate the machine shut-down control 66 in this embodiment.

In operation, the ejection rolls **20*a* and *b* and 22 *a* and *b*, grip an insert that is fed by the pull-foot feeding devices 14 and the bottom rollers 18. The ejection roll sets 20 and 22 positively transport these inserts to the nip of the lower and upper detection rolls 32 and 34. Once an insert sheet is between the detection rolls 32 and 34, the clock 68 is energized by linkage with the pull-foot feeding devices 14 to provide pulses to the counters 62 and 64. If the sheet is of the right thickness, the detection feeler 40 is not touching either of the double or miss electrical contacts 58 or 60, and no signal reaches the counters 62 or 64. However, if there is either a double or a missed insert, the detection feeler 40 will touch respectively the double or miss electrical contact 58 or 60 to thereby complete an electrical circuit to a respective counter and a signal will respectively be fed to that counter. In this event, however, the pull-foot feeding device continues to feed inserts. If the next time the clock 68 provides a pulse to the same counter there is again a similar mistake, a signal will again be sent to that counter. The counters 62 and 64 are adjustable to count to a desired number of counts before ejecting signals to the machine shutdown control 66. Assuming that the "miss" counter 64 is set for three misses, when there have been three misses, the counter 64 sends a signal to the machine shutdown control 66** and the overall pull-foot insert feeding mechanism is shutdown. An operator, at the point, checks out the system to find out what the problem is.

A counter 70 resets the double and miss counters 62 and 64 every predetermined number of feeds of sheets by the pull-foot feeding devices 14 as measured by the clock 68.

It should be recognized that the arrangement of the ejection rolls **20*a* and 20*b* and 22*a* and 22*b* allow easy access by an operator to the suction cup 16 as well as to the bottom rollers 18 and the feet of the pull-foot feeding devices 14**.

Further, it will be appreciated by those skilled in the art that by positioning the nip 38 of the lower and upper detection rolls 32 and 34 slightly downstream of the upper and lower ejection rolls **22*a* and 22*b***, only those sheets which are or are not, actually fed by the pull-foot mechanism can produce indications of "doubles" or "misses."

Finally, allowing the point arm 46 to pivot about pivot 50, allows the detection feeler 40 to be rigid and therefore more accurate. In this regard, when the rigid detection feeler 40 contacts the double electrical contact 58, but yet must move further to allow an undue number of sheets to pass between the lower and upper detection rollers 32 and 34, the pivot arm 46 rotates to allow such further movement.

Figure 3:
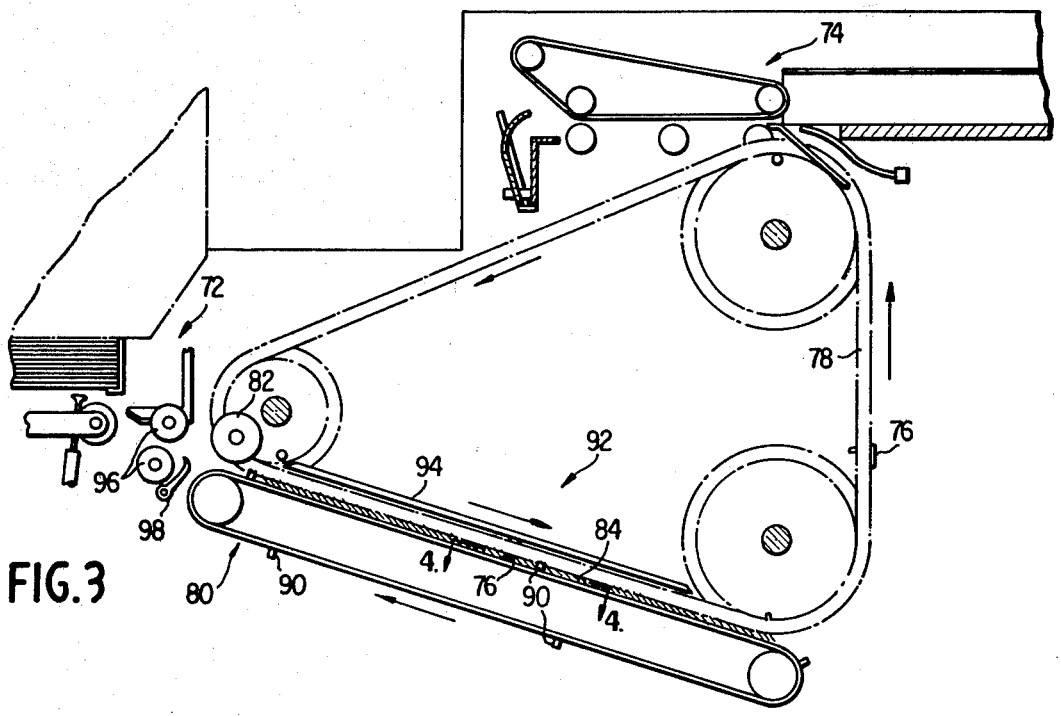
FIG. 3 is a sectional view of a portion of another embodiment in-line inserter for transporting envelopes from a pull-foot feeding device to a stuffing station.
Figure 4:
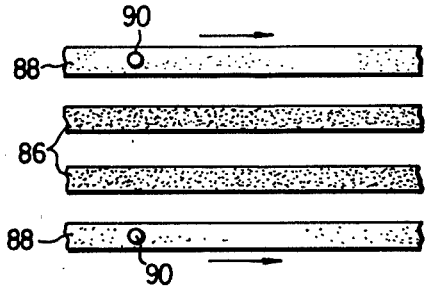
FIG. 4 is a sectional view taken on line 4—4 of FIG. 3.

Turning now to the envelope feeding system of FIGS. 3 and 4, the overall purpose of this system is to feed envelopes received from a pull-foot feeding mechanism 72 to a stuffing station 74. Broadly, this is done by gripping the envelopes with clamps 76 mounted on an endless chain 78, and driving the endless chain. This broad arrangement is described in detail in the Morrison, et al application mentioned above.

This invention conveyor for transferring envelopes from the pull-foot feed mechanism 72 to the clamps 76 of the chain 78. In this respect, it is difficult to time the feeding of envelopes so that they fit properly into the jaws of the clamps 76 at the time that the clamps close. The transition conveyor cmprises an endless conveyor system 80, an entrance roll 82, and a brush 84. The endless conveyor system 80 compri ses two high-speed endless belts 86 (FIG. 4) that are positioned between low-speed registration belts 88. All of these belts travel in approximately coextensive parallel paths. The high-speed endless belts 86 have rougher surfaces than the low-speed registration belts such that the high-speed endless belts have more influence on driving envelopes that are placed on these belts. In one embodiment, the high-speed endless belts 86 are raised slightly higher than the low-speed registration belts, to insure their greater influence of driving.

The low-speed registration belts, however, have registration pins 90 thereon that are arranged in sets of two. These pins extend into the path of sheets driven by the high-speed endless belts.

The brush 84, contacts the upper sides of the envelopes on the endless conveyor system 80 to urge the envelopes toward the high-speed endless belts 86.

The clamps 76 on the endless chain 78 and the pins 90 on the low-speed registration belts 88, travel at the same speed and are in coincidence with each other so that sheets driven against a set of pins 90 are also in a clamp 76 at a station 92. At this station, the clamps are held open by a cam 94.

In operation, envelopes are ejected one at a time from the pull-foot feed mechanism 72 by ejection rolls 96. The flaps of these envelopes are opened by a reciprocating envelope-flap opener 98. Each envelope is picked up by the high-speed endless belts 86 and the entrance roll 82, but thereafter it continues to be fed by the high-speed endless belts 86 and the brushes 84. The high-speed endless belts 86 drive the envelope against a pair of registration pins 90, and thereafter, the high-speed endless belts 86 slip, to hold the envelopes in registration against the pins. Since these pins are synchronized with, and coincident with, open clamps 76 at the station 92, the leading edge of the envelope is inserted into an open clamp 76 where it remains until the clamp and the envelope pass the cam 94, at which time the clamp closes. The The clamp then carries the envelope to the stuffing station 74.

It will be appreciate by those skilled in the art that this transition conveying system allows continuous operation of the envlope feeding system while providing accurate registration of envelopes and controlled placing of the envelopes in conveying clamps.

Figure 5:
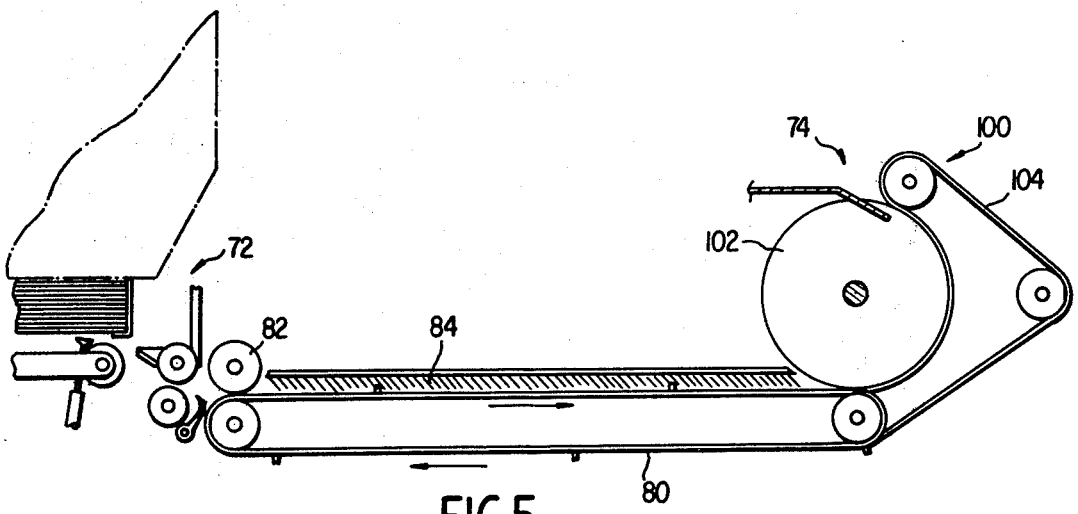
FIG. 5 is a sectional view of an alternate embodiment of a transporting system for transporting envelopes frm a pull-foot sheet feeding mechanism to a stuffing station of an in-line inserter.

FIG. 5 depicts an embodiment of this invention wherein an endless conveyor system 80 identical to the endless conveyor system 80 of FIGS. 3 and 4, is used to convey envelopes from the pull-foot feed mechanism 72 to a drum/belt feed mechanism 100. In this case, the drum/belt feed mechanism 100 replaces the endless chain 78 and clamps 76 of the FIG. 3 embodiment. However, operation of the endless conveyor system 80 is the ame as described with reference to FIG. 4. When envelopes leave the endless conveyor system 80 of FIG. 5, they are clamped between a drum 102 and a belt 104 which are driven to move the envelopes to the stuffing station 74.

Again, it will be understood by those skilled in the art that the conveyor system 80 provides continuous feeding of envelopes, while insuring registration and controlled speed of the envelopes.

Although this invention has been described in connection with several embodiments, it will be understood by those skilled in the art that additional changes and modifications could be made within the scope of the invention.

I claim:

1. In a sheet-feeding system of the type comprising:
a sheet supply means for normally suppling sheets one, at a time;
a sheet transporting means for receiving said supplied sheets and further transporting said sheets; and,
a detection means for engaging said sheets as they are being transported from said supply means to detect the presence of miss or double feeds;
the improvement wherein said detection means comprises a frame and further comprises complementary first and second hard gripping members , a first gripping member of which is mounted on said frame by a pivotal detection lever so that the first gripping member has freedom of lateral movement away from the second gripping member, the second gripping member having no substantial lateral movement, said detection means further including an elongated detection feeler fixedly attached to and movable with, said pivotal detection lever, said detection means still further including a single adjustable, point arm supporting detection points thereon, said points being located on opposite sides of said detection feeler for contacting said detection feeler to indicate movement of said detection feeler in either of opposite directions and being adjustable as a unit with said point arm to simultaneously change the contacting positions of said detection points.

2. In a sheet-feeding system as claimed in claim 1 wherein said gripping members are rolls.

3. In a sheet-feeding system as in claim 1 wherein s aid single adjustable, point arm is a lever with said detection points being located at positions spaced from a pivot point at which said lever is pivotally mounted.

4. In a sheet-feeding system as in claim 3 wherein said point-arm lever includes side walls spaced a distance from one another and being positioned on opposite sides of said detection feeler, said point-arm lever and said pivotal detection lever being pivotally mounted on said frame.

5. In a sheet-feeding system as in claim 4 wherein said feeler is rigid.

6. In a sheet-feeding system as in claim 5 wherein is further included a biasing means attached between said point-arm lever and said frame to pivot said point-arm lever in a first direction and where is further included a stop means mounted on said frame to impinge on said point-arm lever and thereby prevent the point-arm lever from pivoting in said first direction, but allowing said point-arm lever to pivot in the opposite direction in response to pres sure from said detection feeler.

7. In a sheet-feeding system as in claim 6 wherein the position of said stop means is adjustable.

8. In a sheet-feeding system as in claim 1 wherein said point arm incudes side walls spaced from one another on opposite sides of said detection feeler, said detection points being mounted in said opposite side walls.

9. In a sheet-feeding system as in claim 8 wherein is further included a biasing means attached between said point arm and said frame to move said point arm in a first direction and where is further included a stop means mounted on said frame to impinge on said point arm and thereby prevent the point arm from moving in said first direction but allowing said point arm to move in an opposite direction in response to pressure from said detection feeler.

10. In a pull-foot sheet-feeding system comprising:

a sheet supply means for normally supplying sheets, one at a time, said sheet supply means including a reciprocating pull foot and a complementary roller; and a sheet transporting means for receiving said supplied sheets and further transporting said sheets, said sheet transporting means defining a transporting nip for positively gripping said sheets and transporting them; the improvement of a detection means having complementary gripping members, at least one of which is movable, for defining a detecting nip positioned slightly downstream of said transporting nip for detecting the pre ence of miss or double feeds for each reciprocation of said pull-foot, said detection means further including an elongated detection feeler attached to, and moveable with, said at least one movable gripping member, and wherein is further included a single adjustable point arm supporting detection points thereon, said points being located on opposite sides of the said detection feeler for contacting said detection feeler to indicate movement of said detection feeler in either of opposite directions, said single point arm and said points being laterally adjustable as a unit to simultaneously change the positions of said detection points.

11. In a pull-foot sheet-feeding system as in claim 10 wherein said detection feeler is rigid and wherein the positions of said single point arm and the detection points are moveable in response to pressure from said detection feeler.

12. In a pull-foot sheet-feeding system as in claim 11 wherein said single point arm is a single lever pivotal at a pivot point located at one end thereof and having said detection points spaced along said lever from said pivot point.

* * * * *